US005356570A

United States Patent [19]

Golob et al.

[11] Patent Number: 5,356,570

[45] Date of Patent: Oct. 18, 1994

[54] APPARATUS FOR AERATING LIQUIDS

[75] Inventors: Karl Golob, Bonn, Fed. Rep. of Germany; Heinrich Ebner, Linz, Austria; Konrad Ditscheid, Bonn, Fed. Rep. of Germany

[73] Assignee: Heinrich Frings GmbH & Co KG, Bonn, Fed. Rep. of Germany

[21] Appl. No.: 120,005

[22] Filed: Sep. 10, 1993

[30] Foreign Application Priority Data

Sep. 10, 1992 [AT] Austria ..... 1804/92

[51] Int. Cl.[5] ..... B01F 3/04

[52] U.S. Cl. ..... 261/93

[58] Field of Search ..... 261/87, 93

[56] References Cited

U.S. PATENT DOCUMENTS

| | | | |
|---|---|---|---|
| 2,138,349 | 11/1938 | Mallory | 261/93 |
| 2,458,061 | 1/1949 | Coulter | 261/93 |
| 2,767,964 | 10/1956 | Potts | 261/87 |
| 2,767,965 | 10/1956 | Daman | 261/93 |
| 3,439,807 | 4/1969 | Danjes | 261/93 |
| 3,891,729 | 6/1975 | Ebner et al. | 261/87 |
| 3,911,064 | 10/1975 | McWhirter | 261/87 |
| 4,925,598 | 5/1990 | Kivisto et al. | 261/87 |

FOREIGN PATENT DOCUMENTS

| | | |
|---|---|---|
| 0204688 | 1/1990 | European Pat. Off. . |
| 3210473 | 10/1983 | Fed. Rep. of Germany . |
| 2444494 | 7/1980 | France . |

*Primary Examiner*—Tim Miles

*Attorney, Agent, or Firm*—Norbert P. Holler

[57] ABSTRACT

An apparatus for aerating liquids includes a gas- and liquid-feeding rotor (6) and a surrounding stator (7) arranged in the bottom region of a container (2). The rotor (6) is mounted for rotation about a vertical axis, and the stator (7) comprises two vertically spaced, horizontally parallel, annular plates (8, 8*a*) defining a central rotor-accommodating cavity (7*b*) and includes a plurality of circumferentially spaced guide channels (9) located between the plates and arranged non-radially in the direction of rotation of the rotor (6) for conducting the gas-liquid mixture from the stator cavity (7*b*) to the outer perimeter of the stator (7). Connected to the discharge ends of the guide channels (9) are respective elongated, circumferentially spaced distributing pipes (14) for conducting the liquid-gas mixture over a greater basal area of the direct aeration region than would be afforded by the guide channels (9) per se, the distributing pipes (14) being provided with upwardly directed distribution openings (15) over substantially their entire lengths.

10 Claims, 4 Drawing Sheets

APPARATUS FOR AERATING LIQUIDS

This invention relates to an apparatus for aerating liquids, which apparatus is of the type generally comprising a gas and liquid impelling rotor arranged for rotation about a vertical axis of rotation in the region of the bottom or floor of a container, e.g., a tank, basin or lagoon, within the confines of a stator surrounding the rotor and equipped with a plurality of circumferentially spaced guide elements for directing the liquid-gas mixture away from the rotor.

BACKGROUND OF THE INVENTION

In order to enable the liquid in a container to be uniformly aerated with a gas, one usually aims at achieving a uniform distribution of the rotor-impelled liquid-gas mixture over the bottom of the container, in order to ensure a likewise uniform distribution of the rising fine, i.e., very small, gas bubbles over the cross-section of the container. Ordinarily, however, the stator is far smaller in diameter than the container, and thus the cross-sectional area of the aeration region, i.e., the generally columnar region of the body of liquid through which the gas or air bubbles rise toward the surface of the liquid and the perimeter of which region lies at most only a relatively small distance radially outwardly of the projection of the periphery of the stator onto the container bottom, extends through only a relatively small portion of the body of liquid to be aerated. For example, in a large container such as a tank or basin 10 m in diameter (or 10×10 m in size if square) or a lagoon which can be 50×100 m in size or even greater, the aeration region is about 4 m in diameter at most, depending on the size of the aerator. A large container of this type, therefore, cannot be totally aerated by the aerator alone because the bubbles leaving the rotor cannot spread over the entire expanse of the container bottom before rising to the surface.

Quite to the contrary, in a large container the air bubbles rise initially uniformly through a generally columnar region above the centrifugation zone of the submersible aerator, which region, as mentioned, depending on the size of the aerator, is approximately 4 m in diameter. The work generated by the expansion of the air bubbles drives the liquid upwardly. As the level of the liquid above this region is elevated somewhat, the elevated liquid flows at first radially outwardly and then, after a certain outward flow, begins to flow back downwardly until, when near the floor of the basin, it flows back toward the center of the aeration region. As a result of this circulating flow, the descending liquid throttles the air emission from the aerator. This causes the rising air, and with it the liquid, to be confined to a somewhat smaller cross-section, although the quantity of displaced liquid remains the same since it depends only on the work output of the rising quantity of air. With a normal liquid head of about 4 m above the container bottom, therefore, the velocity of upward flow of the liquid attains values which lie between 0.2 and 0.5 m/s. The gas bubbles, however, rise about 0.2 m/s faster than the liquid and thus reach the upper surface of the liquid in a very short time, for example, within 6 to 10 seconds. That means that the residence time of the air bubbles in the liquid is relatively small (as it would be, for example, in a body of liquid only about 1.2 to 2 m deep), with the result that due to the liquid circulation, which is also known as the "airlift effect," the oxygen transfer efficiency (the oxygen consumption expressed in %) and therewith the standard oxygen transfer rate (the oxygen uptake expressed in kg $O_2$/h), as those terms have been defined by the ASME, are correspondingly lower than they should be.

To overcome this drawback, and expressly for the purpose of enabling the basal area of the aeration region at the bottom of the container to be enlarged, it is known from EP-A-204 688 to construct the stator surrounding the rotor as a closed ring of circumferentially distributed, non-radially extending flow channels, by means of which a correspondingly higher outflow velocity of the liquid-gas mixture and thereby also a larger area of centrifugation and expulsion of the liquid-gas mixture can be achieved. The described arrangement, with a suitable limit being imposed on the angular spacing between the flow channels by virtue of the provision of a sufficient number of flow channels, enables a uniform aeration to be achieved over a region having a larger basal area.

The same purpose is served by another known apparatus, disclosed in FR-B-2 444 494, in which the stator is constructed as a mixing chamber for the air directed to the rotor vanes and the liquid drawn into the aerator. In this arrangement, a plurality of distributing pipes for the liquid-gas mixture communicate with the mixing chamber, which again is intended to enable a larger area of centrifugation and expulsion of the liquid-gas mixture to be achieved.

In these known systems, however, it is disadvantageous that the lengths of the distributing pipes cannot be enlarged as desired, because as the pipe length increases the risk exists that the initially created fine small gas bubbles of the liquid-gas mixture will combine and merge with each other in the distributing pipes into the form of larger gas bubbles. This would lead to the result that the sought-for fine distribution of small gas bubbles over the basal area of the provided aeration region is not achieved. In order to avoid having the small gas bubbles exiting from the mixing chamber into the adjacent distributing pipes merge with each other into the form of larger bubbles, it is known from DE-C-3 210 473 to utilize distributing pipes of different lengths, but the maximum attainable expulsion area remains restricted because the different distributing pipe lengths at most have an effect on the gas bubble distribution within the provided expulsion area.

BRIEF DESCRIPTION OF THE INVENTION

It is, therefore, the objective of the present invention to avoid these drawbacks and to provide an improved liquid aeration apparatus of the aforesaid type, which by simple constructional changes enables the basal area for the aeration region to be substantially enlarged.

Generally speaking, the present invention achieves the aforesaid objective by virtue of the fact that the distributing pipes, which in essence extend over substantially the entire enlarged basal area of the aeration region, are provided over their entire length with upwardly directed distribution openings.

By means of the provision of such upwardly directed distribution openings in the distributing pipes, a part of the liquid-gas mixture flowing through the distributing pipes can enter into the body of liquid in the container along substantially the entire length of each distributing pipe before reaching the remote discharge end of that pipe. This on the one hand ensures a corresponding distribution of the small gas bubbles over the full radial extent of the enlarged aeration region through which the distributing pipes extend, and on the other hand inhibits a uniting of the small gas bubbles into the form of larger gas bubbles interiorly of the distributing pipes because the fine small gas bubbles will not be confined under, and hence cannot accumulate in the region of, the upper walls of the distributing pipes. The basal area for the possible aeration region can thus be substantially and efficaciously enlarged, without the system having to tolerate the otherwise arising disadvantages. This is true independently of the rotor and stator construction. The stator can accordingly be constructed both as a guide device for-the liquid-gas mixture expelled from the rotor and also as a mixing chamber.

Apart from the foregoing, it must be considered, in the case of an aeration region which extends over only part of the bottom of the container, that the rising small gas bubbles, as previously mentioned, bring about a liquid circulation in the container, that as a result of such circulation the rise velocity of the gas bubbles in the container is increased by the velocity of the liquid rising through the aeration region, and that thereby the residence time of the gas bubbles in the liquid is correspondingly reduced. By virtue of the enlargement of the immediate aeration region, therefore, the liquid circulation is inherently reduced and the aeration improved.

It will be understood, in this regard, that the lengths of the distributing pipes in any given case can be varied as required for that particular installation. Thus, as a practical matter the distributing pipes will generally be between about 1 m and 5 m long, and preferably between about 2 m and 4 m long, but in more generalized terms the length of the pipes should be such that the diameter of the locus of their axial discharge ends is between about 2 and 4 times the diameter of the stator. In an installation where the pipes will have their axial discharge ends located in proximity to a side wall of a container, those ends should be spaced at most approximately 1 m from the respective walls. Here it should also be understood that in a very large container, for example, a waste water lagoon which, as previously stated, may be as much as 50×100 m or more in size, it may be necessary to install more than one aerator with each of them equipped with a respective set of distributing pipes. In that case, of course, the disposition of each aerator would be such as to ensure that the basal areas of the various enlarged aeration regions, determined by the locations of the axial discharge ends of the respective sets of distributing pipes, are close enough to each other (although not necessarily overlapping one another) to cover the entire expanse of the container.

Inasmuch as during the transfer of the liquid-gas mixture through the distributing pipes, some parts of the mixture already enter into the body of liquid at various locations along the lengths of the distributing pipes, even before reaching the axial discharge ends of the pipes, the feed pressure along the distributing pipes drops correspondingly. In order to avoid having, at each such location, to tolerate a reduction of the exiting portion of the gas proportional to the pressure drop, in accordance with a further refinement of the invention the cross-sectional area of the distribution openings lengthwise of the pipes can be gradually increased toward the discharge ends of the pipes, which contributes to a more uniform aeration of the liquid over the region of the radial extent of the distributing pipes.

The distribution openings can be variously constructed and may, for example, consist of rows of holes at the top sides of the distributing pipes. Particularly simple constructional conditions result, however, when the distribution openings consist of longitudinal slits provided at the top sides of the distributing pipes, through which slits portions of the liquid-gas mixture can continuously leave the distributing pipes over the entire length of the pipes. In order to take into account the pressure drop, in such a case the widths of the slits can increase somewhat in the direction of the axial discharge ends of the distributing pipes.

With respect to the aerating apparatus of the present invention, it will further be understood that if the same were to have distributing pipes of substantial length permanently affixed to the stator at the time of manufacture thereof, both the transportation of the apparatus to and the installation of the apparatus into the container would be likely to encounter difficulties due to the presence of the long pipes. These difficulties can, however, be avoided, in accordance with one refinement of the present invention, by having the distributing pipes individually linked to the stator, in each case for angular movement about a horizontal axis between a substantially horizontal operative position and an upwardly angled, possibly substantially vertical, inoperative position. With such an arrangement of the distributing pipes, the aerating apparatus can then be not only transported (by truck or railway car) from the manufacturing site to the location of the container but also inserted (with the aid of a crane or the like) into the container while in a compact state with its distributing pipes swung into their upwardly extending positions. After the stator has been properly fixed in place on the bottom of the container, the distributing pipes can then be angularly lowered into their use orientations parallel to the bottom of the container. This would be of advantage when only a single aerator is to be installed centrally in a container as well as when one or more aerators are to be installed at different locations in one and the same very large container.

The transportation difficulties that might be encountered in the case of an aerator having the long apertured distributing pipes permanently affixed to the stator, could also be avoided, in accordance with a further refinement of the present invention, by another expedient. Thus, the distributing pipes could be manufactured separately from the stator but with their intake end regions being circumferentially slightly enlarged relative to the discharge end regions of the guide channels of the stator so as to define sleeve-shaped portions adapted to receive the end portions of the stator guide channels. In this case, the distributing pipes would be transported to the location of the container while disassembled from the stator but would then be assembled therewith by sliding the enlarged sleeve-like end regions of the distributing pipes over the corresponding discharge end regions of the stator guide channels with an either smooth or frictional fit. This assembly operation could, of course, be effected before or after the aerating apparatus is lowered into the container if the latter at that time is still empty; obviously, if the container is already filled with liquid, the assembly would have to be done before the apparatus is lowered into the container.

BRIEF DESCRIPTION OF THE DRAWING

The present invention is illustrated by way of example in the drawing, in which.

DETAILED DESCRIPTION OF THE INVENTION

Figure 1:
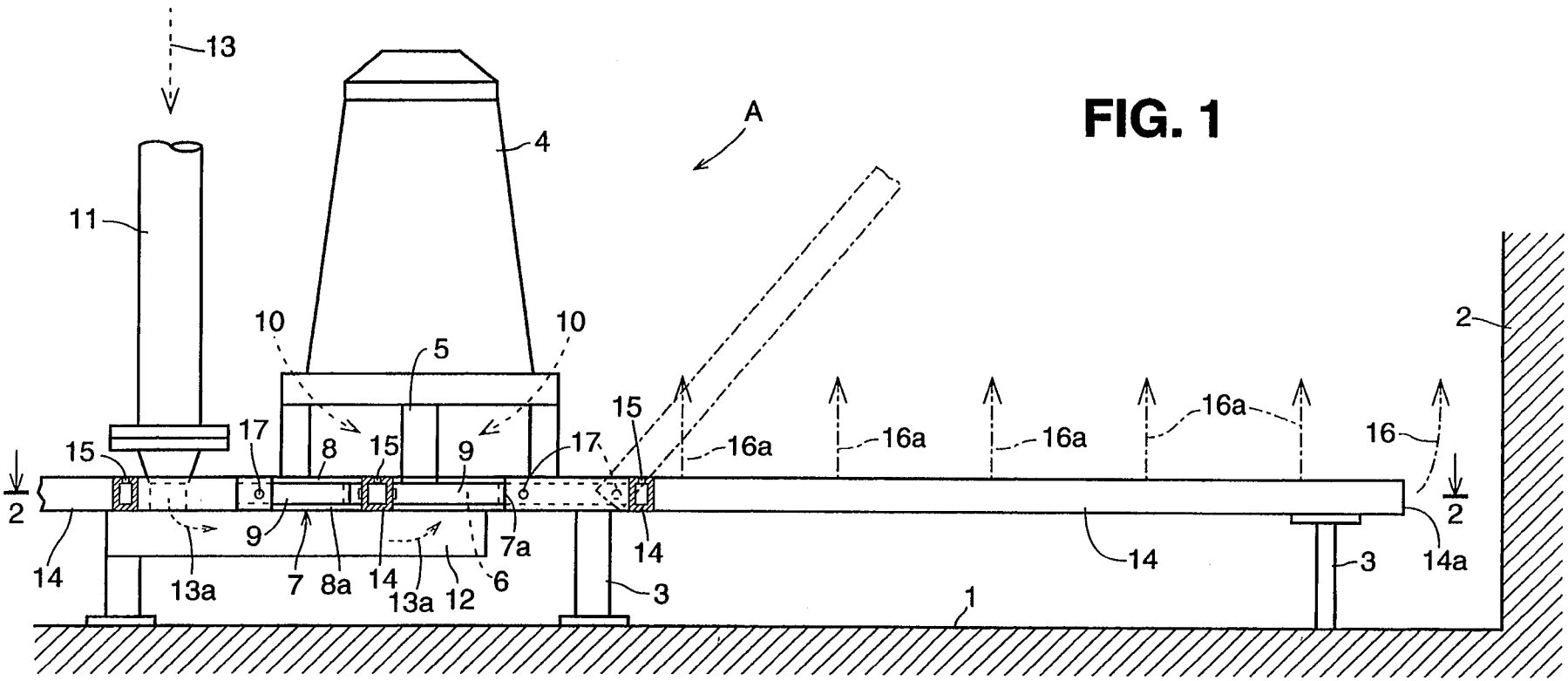
FIG. 1 shows a liquid aerating apparatus according to one embodiment of the invention, the apparatus being illustrated in schematic form in a fragmentary side elevational view and being of the type having the distributing pipes hinged at their intake end regions to the discharge end regions of the stator guide channels, with the horizontal operative positions of the distributing pipes being indicated in solid lines and their upwardly angled inoperative positions being indicated (for one pipe only) in phantom outline.

Referring now to the drawing in greater detail, in accordance with one embodiment of the present invention, the liquid aerating apparatus A, which is shown in FIG. 1 as being situated on the bottom 1 of a container 2 illustrated per se schematically and only in part as having the form of a basin, tank or lagoon, comprises a framework 3 which supports a submersible motor 4 having a shaft 5 for driving a vaned rotor 6. The apparatus further comprises a stator 7 surrounding the rotor 6, the stator including two horizontal, vertically spaced, parallel, annular or ring-shaped upper and lower plates 8 and 8*a* between which are disposed pairs of flat plates or curved pipe sections 9*a*–9*b* (see FIG. 2) defining a plurality of cross-sectionally either rectangular or circular flow or guide channels 9 the orientations of which are inclined relative to the radial direction in the direction of rotation of the rotor designated by the arrow B in FIG. 2. The innermost edges of the stator rings 8 and 8*a*, the axial plate sections 7*a* defining the peripheral boundary of the cylindrical-rotor cavity 7*b* at the center of the stator, and the intake ends of the flow or guide channels 9 located at the boundary of the cavity 7*b* are spaced just sufficiently from the locus of the apex edges of the vanes 6*a* of the rotor 6 as not to interfere with the rotation of the rotor.

It should be noted at this point that the aerator of the present invention as so far described herein is essentially the same, in terms of its structural features, as the aerator disclosed in Ebner et al. U.S. Pat. No. 3,891,729, except for the fact that in the aerator of the present invention the relatively narrow flow or guide channels 9 defined by the paired plates or pipe sections 9*a*–9*b* have replaced the relatively wide spaces defined by the individual guide plates of the earlier aerator. Reference should, therefore, be had to U.S. Pat. No. 3,891,729 for details of the construction, dimensions and dimensional relationships of the rotor and the stator, the possible numbers of vanes on the rotor and guide channels on the stator, the possible angular orientations of the impeller surfaces and air outlet openings of the rotor vanes and the guide channels of the stator, etc.

Insofar as operation is concerned, when the rotor 6 is being driven by the motor 4, a part of the body of liquid in the container 2 (the liquid has not been shown in FIG. 1 for the sake of clarity) is sucked through the upper ring opening of the stator 7, as is graphically designated by the broken-line arrows 10 in FIG. 1, into the several circumferential regions of the cylindrical center cavity 7*b* of the stator which are defined between the vanes 6*a* of the rotor. In those regions, the liquid is mixed with air, designated by the broken-line arrow 13 in FIG. 1, the air having been aspirated by the revolving rotor into the interior of the rotor from the ambient atmosphere around or above the container through a vertical duct 11 located laterally of the motor 4 and a horizontal duct 12 located below the lower stator ring, as indicated by the broken-line arrows 13*a*, and being then expelled by centrifugal force through the air outlet openings in the trailing faces of the rotor vanes into the liquid confined in the aforesaid intervane regions of the central stator cavity 7*b*. The resultant liquid-gas mixture is expelled from the stator cavity into and through the guide or flow channels 9 by the impeller surfaces of the rotor vanes constituted by the leading faces of the vanes.

Figure 2:
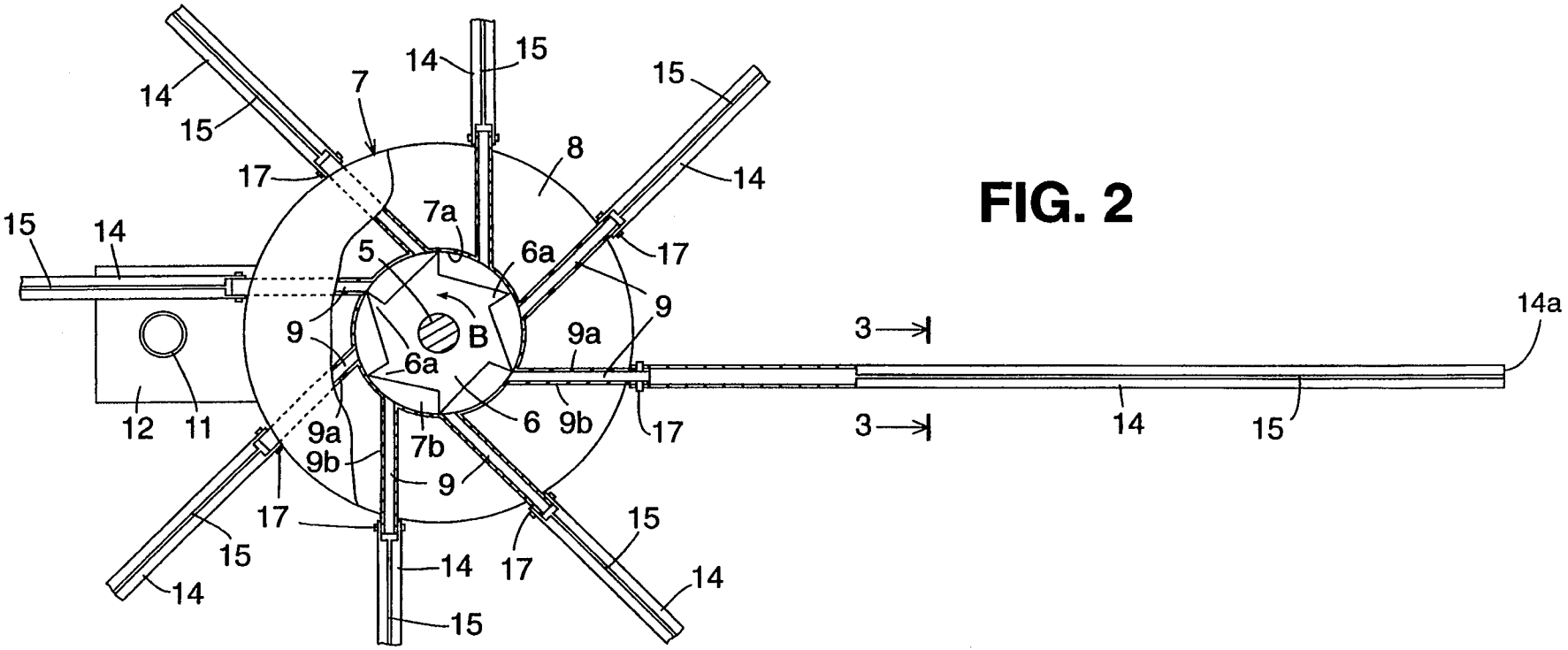
FIG. 2 is a simplified sectional view taken along the line II—II in FIG. 1 and illustrates the distributing pipes with longitudinal slits of constant width in their top wall regions.
Figure 5:
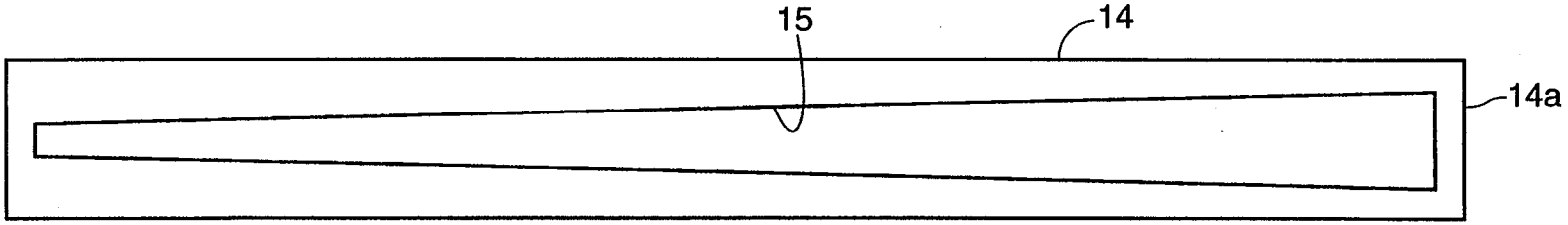
FIG. 5 is a schematic top plan view of one of the distributing pipes shown in FIG. 2 but illustrates the continuous slit-shaped opening in its top wall region as being of gradually increasing width.

As has already been pointed out, in the case of a large aeration container such as a basin or lagoon, where the stator of the aerator occupies a space equivalent to only a limited fraction of the total surface area of the container bottom and where the aerator has the discharge ends of the guide or flow channels 9 thereof located in the known manner at the outer periphery of the stator 7, it is not possible to achieve a uniform aeration of the body of liquid over substantially the entire expanse of the container bottom, because such an aerator provides direct aeration of only that part of the body of liquid found in the generally columnar region above the location of the stator. In order to avoid this drawback, the present invention contemplates the provision, contrary to conventional practice in such an aerator, of a plurality of distributing pipes 14 which at their intake ends are in direct communication with the said guide or flow channels 9 of the stator and which, between their intake and discharge ends, are provided at their top sides with respective distribution openings 15, preferably in the form of longitudinal slits as shown in FIGS. 2 and 5. The distributing pipes 14 are furthermore sufficiently long, for example, as previously indicated, to an extent such that the diameter of the circular locus of their discharge ends 14a is between 2 and 4 times the outer diameter of the stator 7, to extend over substantially the entire desired enlarged basal area of the aeration region.

It will be understood, therefore, that the primary purpose of the distributing pipes 14 is to conduct the liquid-gas mixture exiting from the-guide or flow channels 9 away from the stator, with the interiors of the distributing pipes 14 essentially constituting extensions of the channels 9. At the same time, however, the presence of the distribution openings 15 in the pipes 14 ensures that, while some of the liquid-gas mixture flowing through each such pipe will exit therefrom at the discharge end 14*a* of the pipe, as indicated by the broken-line curved arrow 16 at the right-hand side of FIG. 1, a part of the mixture flowing through that pipe will also exit therefrom along the length of the pipe, as indicated by the broken-line straight arrows 16*a* in FIG. 1. By means of this construction, therefore, it is achieved that fine small gas bubbles enter the body of liquid not just in the regions of the discharge ends of the distributing pipes 14 but rather already over the entire longitudinal extent of the distributing pipes, which ensures the creation of a larger basal area for a possible uniform aeration region. In this connection it should be noted that the fact that the small gas bubbles accumulating in the distributing pipes at the top walls thereof can leave the pipes through the distribution openings 15 will inhibit a merging of these small bubbles into large gas bubbles which would otherwise occur if the distributor pipes were closed at their top walls.

Figure 4:
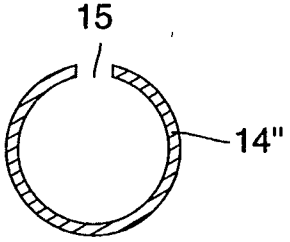
FIG. 4 is a view similar to FIG. 3 but illustrates a different cross-sectional shape of the distributing pipe.
Figure 3:
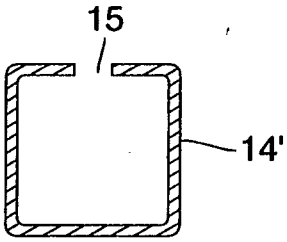
FIG. 3 is a transverse section through one of the distributing pipes of the apparatus shown in FIGS. 1 and 2, the view being taken along the line III—III in FIG. 2 and drawn to an enlarged scale.

The cross-sectional shape of the distributing pipes 14 is per se of secondary significance. Pipes of rectangular or square cross-sectional form, such as is shown at 14' in FIG. 3, can be used just as well as cross-sectionally round pipes, such as is shown at 14" in FIG. 4. Of critical significance is only the provision of the upwardly directed distribution openings 15 through which a part of the liquid-gas mixture can enter upwardly into the container 2 along the full length of each distributing pipe. In this regard it will also be understood that the form of the distribution openings may be varied as desired. Thus, any such opening can consist either of an elongated continuous slit extending almost or entirely the full length of the pipe, as shown at 15 in FIGS. 2 and 5, or of a longitudinally disposed series of relatively small apertures (which may be holes of any desired configuration—round, slit-shaped, polygonal—and of any desired size) distributed in any suitable fashion along the length of the pipe, as shown at 15' in FIGS. 6 and 7.

Figure 6:
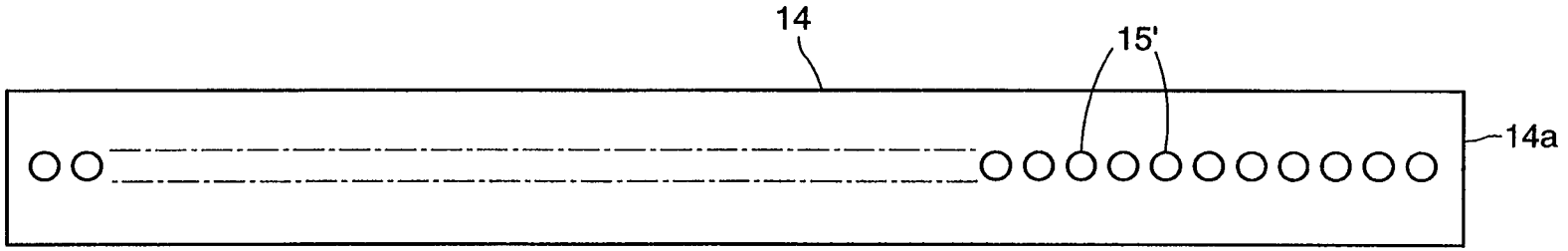
FIG. 6 is a fragmentary top plan view of one of the distributing pipes shown in FIG. 2 but illustrates the constant-width top wall opening in the pipe as being constituted, in accordance with another embodiment of the invention, by a longitudinal series of holes or apertures of equal widths.
Figure 7:
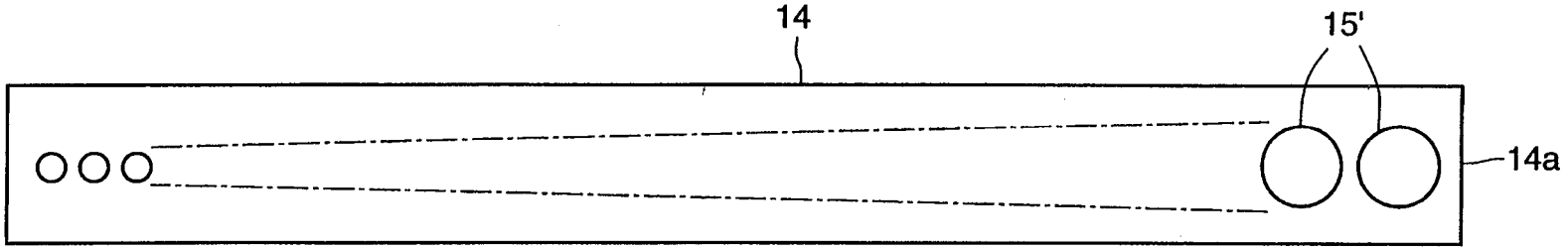
FIG. 7 is a view similar to FIG. 6 but illustrates the holes or apertures constituting the top wall opening of the pipe as having gradually increasing widths.

Insofar as the width of the distribution openings 15 is concerned, it will in general be less than 50% of the width of the associated pipe and preferably will be between 3 and 30 mm. The openings may, of course, be of constant width along their entire length, as shown in FIGS. 2 and 6. A gradual widening of any such opening of a given distributing pipe in the direction of the discharge and of the pipe, i.e., from a minimum width at the end region of the pipe where it communicates with its associated guide or flow channel 9 to a maximum width at the other end region of the pipe, as shown in FIGS. 5 and 7, may be advisable in some circumstances, however, for example, if the pressure drop in the distributing pipes, which normally increases in the flow direction, is to be taken into account and compensated for.

The length of the distributing pipes 14, the number of which will be chosen corresponding to the desired circumferential distribution thereof in dependence on the size of the basal area of the aerating region and will normally be between 4 and 16, and preferably will be between 6 and 12, can be as little as 1 m and as much as 5 m and preferably will be chosen to be between 2 and 4 m. As previously mentioned, the presence of such long pipes, if they were to be fixed to the stator 7 at the manufacturing site so as to be permanently connected to and aligned with the guide channels 9, would most likely unduly complicate not only the installation of the aerating apparatus into the container but also the transportation of the apparatus from the manufacturing site to the site of the container. It is to avoid this problem that the distributing pipes 14 are, in accordance with one refinement of the present invention, pivotally linked to the stator 7, for example, by having a pair of parallel flat extension plates or brackets affixed to the intake end regions of the distributing pipes and swingably connected by pivot bolts 17 to the discharge end regions of the guide channels 9 projecting beyond the outer perimeters of the stator plates 8 and 8*a*. By means of this arrangement, therefore, the distributing pipes 14 can be swung upwardly relative to the stator from their horizontal operating positions about the horizontal axes 17, as is schematically indicated in dot-dash lines in FIG. 1. Such a linking of the distributing pipes 14 to the stator 7 enables the aerator to be both transported and installed while in a relatively compact and easily manipulated state with the distributing pipes swung upwardly, possibly into vertical orientations. The pipes then, after installation of the apparatus, can be swung downwardly into their operating positions parallel to the bottom of the container.

Figure 3A:
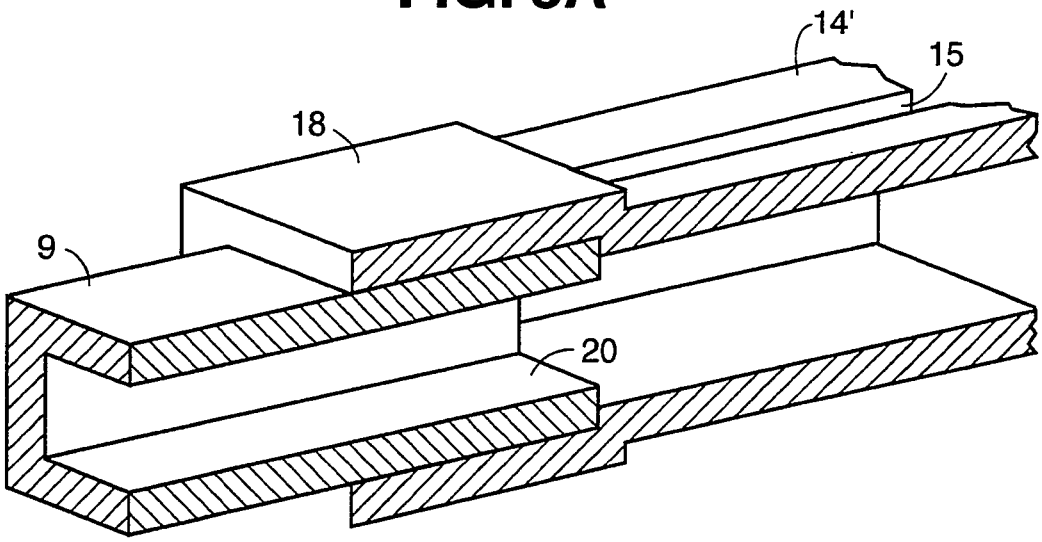
FIGS. 3A and 4A are, respectively, fragmentary perspective illustrations of the slip-on non-pivotal juncture region of the intake end of each of the distributing pipes shown in FIGS. 3 and 4 and the discharge end of its associated stator guide channel according to another embodiment of the invention.
Figure 4A:
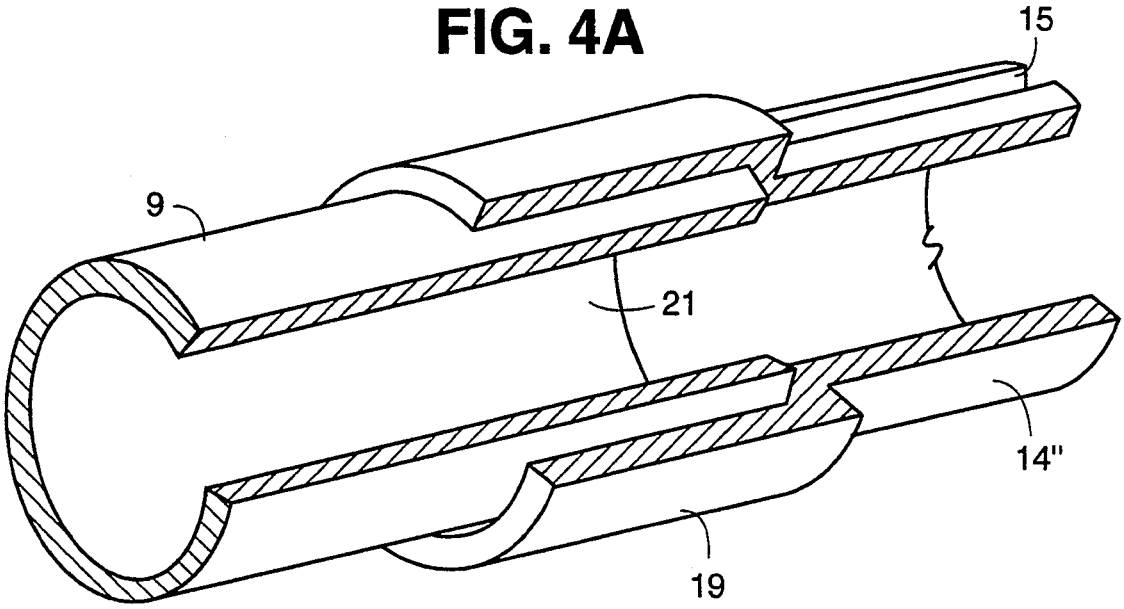

The connection of the distributing pipes 14 to the guide channels 9 can also be effected, in accordance with another refinement of the invention, by means of slip-on or telescopic fittings rather than by means of pivot structures. Such an arrangement requires the distributing pipes, whether polygonal, e.g., square/rectangular, or round in cross-section, to be internally enlarged somewhat at their intake ends, as shown at 18 and 19 in FIGS. 3A and 4A, respectively, with the inner shape and dimensions of each such enlargement being so chosen as to enable it to be slid (with either a smooth or a frictional fit) onto an externally correspondingly shaped and dimensioned end region of an associated stator guide channel 9, as shown at 20 and 21 in FIGS. 3A and 4A, respectively. In this way, the distributing pipes can be transported to the container site even separately from the main body of the aerator and can then be slidingly telescopically fitted at their enlarged intake end regions onto the discharge end regions of the stator guide channels projecting from the stator.

In order to illustrate the operation of the aerator according to the present invention, a cylindrical test tank having a diameter of 3.8 m was filled with pure water to a height of 4 m. For the aeration of this pure water, a self-aspirating immersion aerator was installed, the stator 7 of which had an outer diameter of 500 mm and provided eight flow channels 9 each 150 mm long and having a square cross-sectional shape with side walls each 34 mm wide. By means of this immersion aerator it was possible to transfer 3.07 kg $O_2$/h into the body of pure water and in particular at an oxygen consumption of 27.1%. The basal area of the columnar aeration region was smaller than the full floor of the test tank.

When respective distributing pipes 14 each having a square cross-sectional shape with side walls 37 mm wide were connected to the discharge ends of the flow channels 9 of the stator, the distributing pipes being 1300 mm long and being provided in their top walls with 3 mm wide longitudinal slits extending over the entire length of each pipe, under otherwise the same conditions as previously indicated, an oxygen uptake of 3.86 kg $O_2$/h and an oxygen consumption of 34% were measured, which represented a 25.7% increase in the aeration efficiency.

A test entailing the use of distributing pipes of the same dimensions but without the longitudinal slits of the present invention yielded no appreciable increase of oxygen transfer or aeration efficiency, because only larger air bubbles exited from the discharge ends of the distributing pipes.

The operation of the aerator construction according to the present invention was further tested in a container having a bottom surface area of 10×10 m and at a liquid height of 4.10 m. The installed correspondingly larger immersion aerator aspirated 200 $m^3$/h of air. The stator, the outer diameter of which was 720 mm, was provided with sixteen flow channels 9 each with a 34×34 mm square cross-sectional shape. In the absence of any distributing pipes, it was possible to provide an aeration region having a basal area only about 4 m in diameter. In this case the oxygen transfer was determined to be 10.67 kg $O_2$/h and the oxygen consumption was 17.9%

When this immersion aerator was equipped with a set of distributing pipes 14 each 3 m long and having a top wall slit 4 mm wide, it was possible to achieve a uniform aeration over an aeration region having a basal area approximately 7 m in diameter, and the oxygen transfer was determined to be 13.48 kg $O_2$/h at an oxygen consumption of 22.5%.

For the purposes of an additional test, the width of the slits in the distributing pipes was varied from 1 mm in the region of their ends proximate to the stator to 4 mm at their discharge ends. With the same quantity of air aspirated, it was possible to achieve an improvement in the distribution of the small air bubbles in the body of liquid being aerated, which yielded an oxygen transfer of 15.2 kg $O_2$/h at an oxygen consumption of 25.5%.

The present invention is naturally not restricted to the illustrated embodiments and can be implemented independently of the shape and size of the container and of the structural form of the aerator. Thus, by way of example, the aerating gas can be fed to the rotor either under external pressure or through the use of a self-aspirating rotor. Furthermore, although the aerating apparatus according to the present invention is especially suited for aerating waste water, it can actually be used in any system where it is appropriate to ensure a uniform gas uptake in a liquid over a larger basal area.

We claim:

1. Apparatus for aerating liquids, which apparatus includes a gas- and liquid-centrifuging rotor adapted to be arranged in the bottom region of a liquid-holding container for rotation about a vertical axis of rotation so as to entrain liquid and gas into the form of a liquid-gas mixture and to centrifuge the liquid-gas mixture horizontally outwardly of the rotor, a stator surrounding the rotor and constructed to conduct respective portions of the liquid-gas mixture from the rotor to the outer perimeter of the stator, and a plurality of elongated distributing pipes having respective intake and discharge ends and connected at their intake ends to the stator at a plurality of circumferentially spaced locations for conducting the liquid-gas mixture portions horizontally outwardly away from the outer perimeter of the stator; characterized in that the distributing pipes (14), which extend over substantially the entire basal area of the aeration region, are provided over substantially their entire length with respective upwardly directed distribution openings (15) to enable parts of the liquid-gas mixture portions traveling through the distributing pipes (14) to enter the body of liquid along the entire lengths of the distributing pipes before reaching the discharge ends of the latter.

2. Apparatus according to claim 1, characterized in that the width of each of the distribution openings (15) increases over the length of the respective distributing pipe in the direction of the discharge end of that distributing pipe.

3. Apparatus according to claim 1, characterized in that the width of each of the distribution openings (15) is constant over the length of the respective distributing pipe (14).

4. Apparatus according to claim 1, 2 or 3, characterized in that the distribution opening (15) in at least one of the distributing pipes (14) is constituted by a continuous longitudinal slit provided in the top wall region of that distributing pipe.

5. Apparatus according to claim 1, 2 or 3, characterized in that the distribution (15) opening in at least one of the distributing pipes (14) is constituted by a longitudinal series of discontinuous apertures provided in the top wall region of that distributing pipe.

6. Apparatus according to claim 1, 2 or 3, characterized in that at least one of the distributing pipes (14) is pivotally connected at its intake end to the stator (7) for angular movement about a horizontal axis between a substantially horizontal operating position and an upwardly directed inoperative position.

7. Apparatus according to claim 1, 2 or 3, characterized in that at least one of the distributing pipes (14) has an internally enlarged section (18, 19) at its intake end region and is adapted to be connected to the stator (7) by telescopic sliding interengagement of the enlarged section (18, 19) with a correspondingly shaped and dimensioned adjunct (20, 21) of the stator (7).

8. Apparatus according to claim 1, 2 or 3, characterized in that the distributing (14) pipes are between 1 m and 5 m long.

9. Apparatus according to claim 1, 2 or 3, characterized in that the distributing pipes (14) are between 2 m and 4 m long.

10. Apparatus according to claims 1, 2 or 3, characterized in that the length of the distributing pipes (14) is such as to make the diameter of the locus of their discharge ends equal to between 2 times and 4 times the diameter of the outer perimeter of the stator (7).

* * * * *